US010267109B2

(12) United States Patent
Solem

(10) Patent No.: US 10,267,109 B2
(45) Date of Patent: Apr. 23, 2019

(54) AGITATOR WITH OSCILLATING WEIGHT ELEMENT

(71) Applicant: Advancetech ApS, Gredstedbro (DK)

(72) Inventor: Sigurd Solem, Gredstedbro (DK)

(73) Assignee: ADVANCETECH APS, Gredstedbro (DK)

( * ) Notice: Subject to any disclaimer, the term of this patent is extended or adjusted under 35 U.S.C. 154(b) by 97 days.

(21) Appl. No.: 14/896,061

(22) PCT Filed: Mar. 27, 2014

(86) PCT No.: PCT/DK2014/050073

§ 371 (c)(1),
(2) Date: Dec. 4, 2015

(87) PCT Pub. No.: WO2014/194912

PCT Pub. Date: Dec. 11, 2014

(65) Prior Publication Data

US 2016/0130898 A1 May 12, 2016

(30) Foreign Application Priority Data

Jun. 4, 2013 (DK) ..... 2013 70307

(51) Int. Cl.
*E21B 28/00* (2006.01)
*E21B 7/24* (2006.01)

(52) U.S. Cl.
CPC ..... *E21B 28/00* (2013.01); *E21B 7/24* (2013.01)

(58) Field of Classification Search
CPC ..... E21B 28/00; E21B 7/24; E21B 4/006
See application file for complete search history.

(56) References Cited

U.S. PATENT DOCUMENTS 2,742,265 A 4/1956 Snyder
4,261,425 A 4/1981 Bodine
5,467,684 A * 11/1995 Sher ..... A61B 17/320758 74/129
5,601,152 A 2/1997 Harrison
(Continued)

FOREIGN PATENT DOCUMENTS

CA 2 689 949 A1 7/2011
WO 2012/120403 A1 9/2012

*Primary Examiner* — David J Bagnell
*Assistant Examiner* — Yanick A Akaragwe
(74) *Attorney, Agent, or Firm* — David S. Safran; Roberts Mlotkowski Safran Cole & Calderon, P.C.

(57) ABSTRACT

An agitator tool (1) for introducing forward and backward axial movement in a downhole tool of a drill string, where the agitator tool has a first axially moveable element (5) coupled to a second laterally moveable element (9) arranged inside a housing (2) via mechanical coupling. The mechanical coupling may be a pin and groove arrangement where the groove forms a modified or unmodified sinus shaped guiding loop that allows the first element (5) to oscillate within the housing (2). The second element (9) is driven by a turbine unit which may have flow regulating means. This provides an agitator tool comprising with very few moving and wearable parts. The shape of the groove sections allows an accelerated and/or de-accelerated forward and backward movement of the first element (5) that allows it to be used for various applications in a bore hole.

11 Claims, 3 Drawing Sheets

(56) References Cited

U.S. PATENT DOCUMENTS

| | | | | |
|---|---|---|---|---|
| 8,162,078 | B2 | 4/2012 | Anderson | |
| 9,045,957 | B2 | 6/2015 | Yajure | |
| 2008/0271923 | A1* | 11/2008 | Kusko | E21B 4/02 175/25 |
| 2012/0186878 | A1 | 7/2012 | Eddison | |
| 2014/0154808 | A1 | 6/2014 | Patel | |
| 2015/0315846 | A1* | 11/2015 | Tulloch | C09J 183/04 175/57 |

* cited by examiner

AGITATOR WITH OSCILLATING WEIGHT ELEMENT

BACKGROUND OF THE INVENTION

Field of the Invention

The present invention relates to an agitator tool for introducing axial movement in a downhole tool, e.g., of a drill string in a bore hole, where the agitator tool comprises:

- a housing configured to be positioned in the bore hole, wherein the housing has a first open end connected to a second open end via at least an inner surface, wherein the housing is configured to guide at least a portion of a drilling fluid through the housing via the first and second open ends;
- a drive unit, e.g., a fluid activated drive unit, configured to drive the agitator tool, wherein the drive unit is configured to be coupled to a first moveable element arranged inside the housing; and
- wherein the first element is configured to move in an axial direction relative the housing for introducing axial movement in an external downhole tool coupled to the agitator tool when the drive unit drives the first element.

Description of Related Art

The present invention also relates to the use of such an agitator tool.

Today, bore holes (also called wellbores) comprise an upper hole section coupled to a movable or stationary drilling rig for reaching the desired drilling depth and a lower hole section reaching the desired reservoirs, e.g., an oil or gas reservoir, in the underground. The bore hole is typically a vertical hole that turns or branches off into one or more horizontal holes in which the drill string is subjected to various loads, such as gravity, pore pressure of the surrounding material, fluid density, and pressure/torque/weight from the moving drill parts. The drilling fluid, e.g., mud, is typically circulated inside the drill string, then through the bit and into the annulus. The mud then lifts the cuttings to the surface and thereby cleans the hole. It is well-known that the production output and thus the profit of the bore hole is often determined by the length of the reservoir section. It is known to use an agitator tool to introduce movement in a downhole tool in a drill string which reduces friction between the drill string and the sidewalls of the bore hole and allows the length of the bore hole to be increased.

An example of such an agitator tool is the NOV agitator (U.S. Pat. No. 8,167,051 B2) from the company NOV which comprises a mud motor with a rotor and stator configuration coupled to a valve arrangement which in turn is often coupled to a shock sub. The mud motor drives the valves which expand the drill string under increased pressure. This configuration has the disadvantage that it generates a high fluctuating pressure drop that interferes with the data transmission through the drilling fluid. This configuration also has a temperature problem as the stator elastomer is limited by temperature.

U.S. Pat. No. 8,162,078 B2 discloses another agitator tool comprising an annular turbine that rotates relative to an output opening in the outer housing. As the turbine rotates, the pressure in the drilling fluid will continuously increase and decrease as an inner opening in the turbine passes the output to the annulus. This increased internal pressure causes the drill string to expand which will interfere with the data transmission through the drilling fluid.

Both of the above described solutions require a shock absorbing tool to be placed behind the agitator tool in order to absorb the reactive movement that follows the forward movement, as described in Newton's third law of equal and opposite forces. The valves and openings formed in these tools are likely to plug due to the particles, solids and LCM in the drilling fluid which may cause the tool to fail due to the increasing internal pressure.

U.S. Patent Application Publication 2012/0186878 A1 describes an agitator tool comprising a mud motor driving a rotating shaft having an offset end which controls the flow of the fluid to a reciprocating piston. The piston is in turn coupled to a movable mass which is brought into contact with a drill bit when the piston is moved forward. The valve openings formed in this tool are also likely to plug due to the particles and solids in the drilling fluid which may cause the tool to fail due to the increasing internal pressure. This configuration has a relative complex structure with a lot of wearable parts which need to be cleaned or serviced at regular basis.

U.S. Pat. No. 5,601,152 discloses an agitator tool comprising a rotating spindle subassembly coupled to a vibrational subassembly that moves a lower sub-assembly in a reciprocating manner in an axial direction. The drill string rotates the spindle assembly which rotates a main body part of the vibrational subassembly. The main body part drives a first shaft having a radial extending pin. A second shaft is pivotal coupled to the radial extending pin and is connected to a T-shaped element of the lower sub-assembly. As the first shaft is rotated the second shaft is pivoted around the radial pin for each revolution. This leads to a reciprocating movement of the lower assembly in the axial direction. The agitator tool has a relative complex configuration with a large number of components that increase the risk of one or more components failing during operation, particularly the pivoting components. The pivotal shaft provides a limited axial movement of the lower assembly, thus reducing the effect of the agitator tool. This configuration delivers a hammer action to the system interfering with the data transmission through the fluid and provides very narrow passageway for the fluid to pass through the tool increasing the risk of blockages.

International Patent Application Publication WO 2012/120403 A1 discloses a downhole tool comprising an axial moveable mass coupled to a rotatable drive axle by means of a wobble plate and a connecting rod. The connecting rod is located on the end surface of the mass where the free end is coupled to the periphery of the wobble plate located on a side surface of the drive axle. A protective spring is arranged in or relative to the downhole tool to protect the wobble plate when applying a hammer effect.

SUMMARY OF THE INVENTION

An object of the invention is to provide an agitator tool that reduces friction between the drill string and the inner wall of the bore hole and improves weight transfer from the drill string to the drill bit.

An object of the invention is to provide a forward movement of an oscillating weight without an equal backward movement through the design of sinus shaped curves.

An object of the invention is to provide an agitator tool that has a simple configuration and less wearable parts, and which has a relative constant pressure drop during operation.

An object of the invention is to provide an agitator tool that does not interfere with the data transmission trough the drilling fluid.

An object of the invention is to provide an agitator tool that can be used for various purposes, such as fishing for objects, pulling items, or moving and landing tube or casings.

An object of the invention is achieved by an agitator tool characterized in that a second moveable element is arranged inside the housing, wherein the second element is configured to be coupled to the drive unit and to move, e.g., rotate, in a lateral direction relative to the first element, wherein the first and second elements are arranged relative to a common center axis; and wherein the first element is coupled to the second element via mechanical coupling means for converting the lateral movement of the second element into the axial movement of the first element.

This provides an agitator tool suitable for the use in bore holes in which drilling fluid, such as drilling mud, are pumped through the drill string and into the bore hole, e.g., a bore hole for natural gas, such as shale gas. This agitator tool is configured to be driven by the drilling fluid being pumped through the agitator tool and out to the drill bit. This agitator tool has a simple structure and comprises very few moving and thus wearable parts, unlike other agitator tools which have a complex structure and a lot of wearable parts. The oscillating movement between the two elements in the housing causes a weight imbalance that introduces an axial movement in the downhole tools coupled to the agitator tool. This reduces the friction between the drill string and the inner wall of the bore hole and allows weight from the drill string behind the agitator to be transferred to the drill bit. This reduces the maintenance time and increases the operation time since it does not comprise any valves or narrow flow paths. The length of the drill string may be increased horizontally up to 12 kilometers or more.

The housing may comprise a support element in the form of one or more taps or an annular protrusion located near the first open end of the housing for supporting the parts arranged inside the housing. This allows the parts of the agitator tool to hang freely from the support element which eliminates the need for any supporting bearings located in the opposite end of the housing. A support stack may be placed on a contact surface of the support element. The stack may comprise one or more bearings, such as a radial bearing and/or a thrust bearing, and optionally damping means in the form of one or more spring elements, e.g., Belleville springs.

The first open end may comprise coupling means in the form of a screw thread with internal or external threads for coupling to another housing or downhole tool with a mating coupling. The second open end may additionally or alternatively comprise coupling means in the form of a screw thread with internal or external threads for coupling to another housing or downhole tool with a mating coupling. The agitator may be placed after the drill bit or a measuring unit or at any other position in the drill string.

The coupling means comprises a first coupling element located on a first surface of the first element which is configured to engage a second coupling element located on a second and opposite facing surface of the second element, and wherein the first coupling element is configured to move along the second coupling element when the drive unit drives the second element.

The two moveable elements are coupled together via a mechanical coupling that converts the rotating movement of the second element into an axial movement of the first element. This eliminates the need for any valve arrangements and/or pistons to drive the first element which in turn reduces the number of parts in the agitator tool and provides a configuration that is more resilient to wear during operation. This also eliminates the need for a valve arrangement that would cause fluctuations in the pressure drop over the agitator tool.

According to one embodiment, the first coupling element is a pin extending out from a first surface of one of the elements and the second coupling element is a groove, e.g., a curved and/or straight groove, arranged on a second surface of the other element, wherein the groove is configured to at least partly receive the free end of the pin.

The mechanical coupling may in a simple embodiment be a pin and grove arrangement where the groove has a configuration that allows the pin to move along the grove when the two elements move relative to each other. The groove is shaped to receive the free end of the pin where the thickness or diameter of the pin more or less corresponds to the width of the groove. The width of the groove may be increased to allow for a more loose fit around the pin. This allows for a looser travel of the pin and allows it to compensate for any tolerances between the outer surfaces of the groove and pin. The pin may form part of the element for a stronger coupling or be coupled to the element via fastening means, such as screws, bolts, nuts, or a threaded coupling, for easy assembly. The pin may be inserted through a mounting hole in the outer surface of the first element during assembly.

The coupling means may have any other configuration, such as a cam and follower system where a rotating cam contacts and moves a follower. The rotating second element may comprise a drum or cylindrical shaped cam or be coupled to a drum or cylindrical shaped cam element where the cam has a contact surface for contacting a contact surface on the axial moving of the first element. The first element may comprise a mating drum or cylindrical shaped cam or be coupled to a mating drum or cylindrical shaped cam element. The first element may instead comprise or be coupled to a roller follower having at least one rotating element. The second contact surface is located on the cam or the rotating element of the roller follower.

According to one embodiment, the second coupling element forms at least a first guiding section for forward axis movement of the first coupling element, where the first guiding section is connected to at least a second guiding section for backward axis movement of the first coupling element, and wherein the first and second sections form a guiding loop for the axial movement of the first coupling element.

The groove forms a closed guiding loop along the surface of that element that allows the first element to move forward and backward in an oscillating manner. The groove has at least one groove section with a predetermined amplitude, pitch and length that provides a forward movement and at least one other groove section with a predetermined amplitude, pitch and length that provides a backward movement. The groove may be configured so that the first element performs one cycle per one revolution of the second element. The speed and number of cycles per revolution may be increased by arranging more than two groove sections on the surface.

According to a special embodiment, the first and second guiding sections has a symmetric shape, e.g., a sinus shaped groove, or at least one of the guiding sections has a modified shape, e.g., a predetermined amplitude, pitch and/or period, that differs from its symmetric shape for accelerating or de-accelerating the axis movement of the first coupling element.

The two groove sections may form a sinus curve or any other shape having a predetermined amplitude, frequency/period and pitch. The shape of each groove section may be symmetrically shaped around a peak section connecting the two groove sections thereby allowing for a uniform movement of the first element. At least one of the groove sections may have a modified shape where the amplitude, pitch and/or period of that groove section differ from its symmetric values. One or both peak sections may be modified accordingly. This allows the movement of the first element to be accelerated and/or de-accelerated between the peaks and provides a fast and/or slow stop at the peaks or allows the total movement to be neutral. The entire length of the groove section may have a curved shape or at a part thereof may have a straight shape. The amplitude, frequency/period and pitch of the groove sections may be determined based on various desired criteria, e.g., flow rate, number of cycles per revolutions, type or weight of drilling fluid, viscosity of fluid, size of drill string, or the like.

One of the groove sections may have an unmodified shape while the other groove section has a modified shape thus providing an aggressive movement. At least one of the peak sections between the groove sections may be shaped to provide a fast or slow stop, i.e. have a straight or flat curvature. This allows the speed of the forward and backward movement to differ. The groove sections may be designed according to Newton's third law so that the agitator tool provides an equal action and reaction or an increased action or reaction, e.g., slow down the reaction of the stroke.

According to a special embodiment, one of the sections has a guiding subsection which has a third shape that differs from the remaining shape of that section for a third axial movement, e.g., a stroke movement, of the first coupling element.

At least one of the groove sections may have a sub-suction that has a different shape than the rest of the groove section. The width of the groove in this sub-section may be increased, e.g., by forming a curved recess and/or protrusion in one of the side surfaces of the groove. This allows the first element to perform a positive (forward) or negative (backward) stroke movement every time the pin passes that sub-section. This allows the agitator tool to perform more than one stroke movement per cycle.

According to one embodiment, the first element is a cylinder and the second element is a shaft and wherein the cylinder has a first surface facing the shaft and the shaft has a second surface facing the cylinder, where the shaft preferably extends at least partly into a cavity of the cylinder.

The first element is preferably configured as a weight element having a predetermined mass and weight. The weight element may in a preferred embodiment be shaped as a cylindrical element. The second element is preferably configured as an activating element which activates or drives the second element. In a preferred embodiment, the activating element is shaped as a shaft that is configured to be coupled to the drive unit. The shaft may extend through the weight element or into a cavity of the weight element.

The pin may be shaped as a single elongated pin or an L- or T-shaped pin extending out from a surface, and the groove may be arranged on an opposite facing surface where the free end(s) of the pin is placed in the groove. The pin may be located on an inner surface or end surface of the first element facing the second element, and the groove may be located an outer surface or end surface of the second element facing the first element, or vice versa. The pin may be mounted on a bearing for reducing friction in the groove.

According to one embodiment, guiding means is arranged between an outer surface of the second element and the inner surface of the housing for restricting the movement of the first element to an axis movement relative to the second element.

Guiding means in the form of a spline system may be arranged between the housing and the first element where a first spline element is coupled to the inner surface of the housing and a second spline element is coupled to the outer surface of the first element. The two spline elements may be shaped as elongated guiding protrusions where the two sets of protrusions are offset relative to each other. The width between two adjacent protrusions may more or less correspond to the width of an opposite mating protrusion. The width between two adjacent protrusions may be increased to allow the opposite protrusion to move freely wherein. The spline system may be configured to guide the first element along a first path and guide it backward along a second path. This prevents the first element from rotating with second element.

According to one embodiment, at least a first sealing system is arranged at the first open end, wherein at least one of the elements, e.g., the second element, extends through the sealing system and comprises at least one inlet opening connected to a fluid path which is turn is connected to at least one outlet opening.

The housing may be sealed off at both open ends using a sealing system in the form of a circular or ring shaped seal coupled to contact the inner surface of the housing and the outer surface of the drive unit or second element. The shaft forming the second element may extend through the seal at the first open end and comprise one or more inlets for leading the drilling fluid into a flow path arranged inside the shaft. The flow path extends through the shaft and is connected to one or more outlets at the second open end for leading the drilling fluid out to the drill bit. This allows a guide wire to be guided through the hollow shaft and thus through the agitator tool.

A seal in the form of a pressure compensating system may be used to seal off the second open end thus forming a closed chamber in which the first and second elements are arranged. The first and second elements may be submerged in another suitable fluid, e.g., oil or water, for reducing friction of the moveable elements. The drilling mud may be used instead.

The housing may have a cylindrical shape and an inner diameter that is greater than the outer diameter of the first cylindrical element. A gap at either end between the seals and the first element and a gap between the first element and the housing allow the first element to move freely and displace the second fluid in the chamber.

According to a special embodiment, a pressure compensating system is arranged at the second open end for compensating for a pressure difference between the fluid inside the housing and the fluid outside the housing.

The pressure compensating system may be a moveable balance piston having a sealing element for contacting the inner surface of the housing and a second sealing element for contacting the outer surface of the first or second element. The pressure compensating system seals off the second open end while regulating the pressure inside the chamber based on the pressure outside the open end. The pressure compensating element is positioned relative to the first sealing system so that the first element is able to move freely within the amplitude of the groove or cam of the second element even at the maximum allowable pressure difference caused by hydrostatic column, pump pressure or weight of the drilling fluid.

According to one embodiment, at least one protrusion is arranged on the inner surface of the housing and comprises a first contact surface for contacting a second surface on the first element when the first element moves in an axial direction.

A protrusion in the form of one or more taps or an annular protrusion may be located at or near the open end. The protrusion may comprise a contact surface facing the first element for contacting a mating contact surface on the first element. The protrusion is located relative to the support element so that the first element impacts the protrusion during the forward movement thus providing a hammer or anvil effect. The groove may at or around the point when the first element contacts the protrusion have a greater width than the remaining part of the groove which allows the pin to move freely relative to the groove during the impact. The sub-section may be used to provide the impact with the protrusion.

According to one embodiment, at least another moveable first element is coupled to the second element by another set of coupling means, wherein the set of coupling means comprises a third coupling element configured to move along a fourth coupling element when the drive unit drives the second element.

Two or more first elements may be coupled to the same second element where both first elements are coupled to the second element via two mechanical couplings in the form of a pin and groove system and/or a cam and follower system. The weight of the first elements may be adapted to the desired application, dimensions of the agitator tool, or the force of forward movement or hammer effect. The weight of each first element may differ from each other as well as the amplitude, frequency and pitch of each mechanical coupling. This allows the frequency and effect of the movement to be adapted to the desired application and use.

According to one embodiment, the drive unit is configured as a turbine or progressive cavity pump, wherein the drive unit comprises at least one blade arranged on a shaft for leading at least a part of the drilling fluid through the drive unit, and wherein preferably flow regulating means are arranged in front of the drive unit.

The use of any type of turbines to drive the agitator tool provides a more stable pressure drop which does not interfere with the data transmitted through the drilling fluid, such as MWD (Measurement While Drilling) or other pressure conveyed information. This also eliminates the temperature problem since it does not comprise a stator with an elastomer. The turbine may comprise a plurality of turbine blade arranged on a shaft which is configured to be coupled to the second element via coupling means in the form of a screw thread. The turbine shaft may have internal threads for coupling to external threads of the second element, or vice versa. The turbine blade may be configured to rotate the second element in a clockwise or counterclockwise direction. This allows the drive unit to be configured as a separate unit that can be easily coupled to the second element. The drive unit alternatively may be a conventional progressive cavity pump. The progressive cavity pump may be any type of stator/rotor configuration rating from half-lobe to multi-lobe and multi-stage systems. The drive unit may be arranged in a second housing which is coupled to the first open end of the first housing. This second housing may comprise coupling means in the form of a screw thread with internal or external threads for coupling to another downhole tool with a mating coupling.

The turbine may at the opposite side of the coupling means be coupled to a flow restrictor for regulating the amount of the fluid passing through the turbine blades and the flow path in the shaft. The flow restrictor may have a static configuration where the flow is set to a predetermined rate during assembly or may have a dynamic configuration that allows the flow rate to be adjusted during operation, e.g., via an external control unit.

A third housing for protecting the outlets of the second element may be coupled to the second open end of the first housing. This third housing may comprise coupling means in the form of a screw thread with internal or external threads for coupling to another downhole tool with a mating coupling.

The embodiments of the agitator tool allow it to be used for any one of the following applications: drilling bore holes, e.g., horizontal bore holes; moving items, e.g., casings or tubes, in a bore hole; fishing for objects in a bore hole or/and installing and removing monopole foundations.

The agitator tool may be used when drilling a bore hole to introduce forward movement in a drill bit. The oscillating internal weight elements allow the agitator tool to also be used to push or pull other item in a bore hole, such as casing, tubes, packers, pumps, screens, or the like. The forward movement force and the hammer effect may also be used to fish for lost or stuck item in the borehole where the agitator tool may be used to "vibrate" the item and retrieve the item. In a special embodiment, the size of the agitator tool may be increased and/or the second housing may configured to be coupled to or placed on the upper end of a monopole foundation, e.g., for wind turbines or other offshore units. The oscillating internal weight elements are then used to install and then loosen the monopole foundation from the seabed.

The invention is described by example only and with reference to the accompanying drawings.

DETAILED DESCRIPTION OF THE INVENTION

In the following text, the figures will be described one by one and the different parts and positions seen in the figures will be numbered with the same numbers in the different figures. Not all parts and positions indicated in a specific figure will necessarily be discussed together with that figure.

Figure 1:
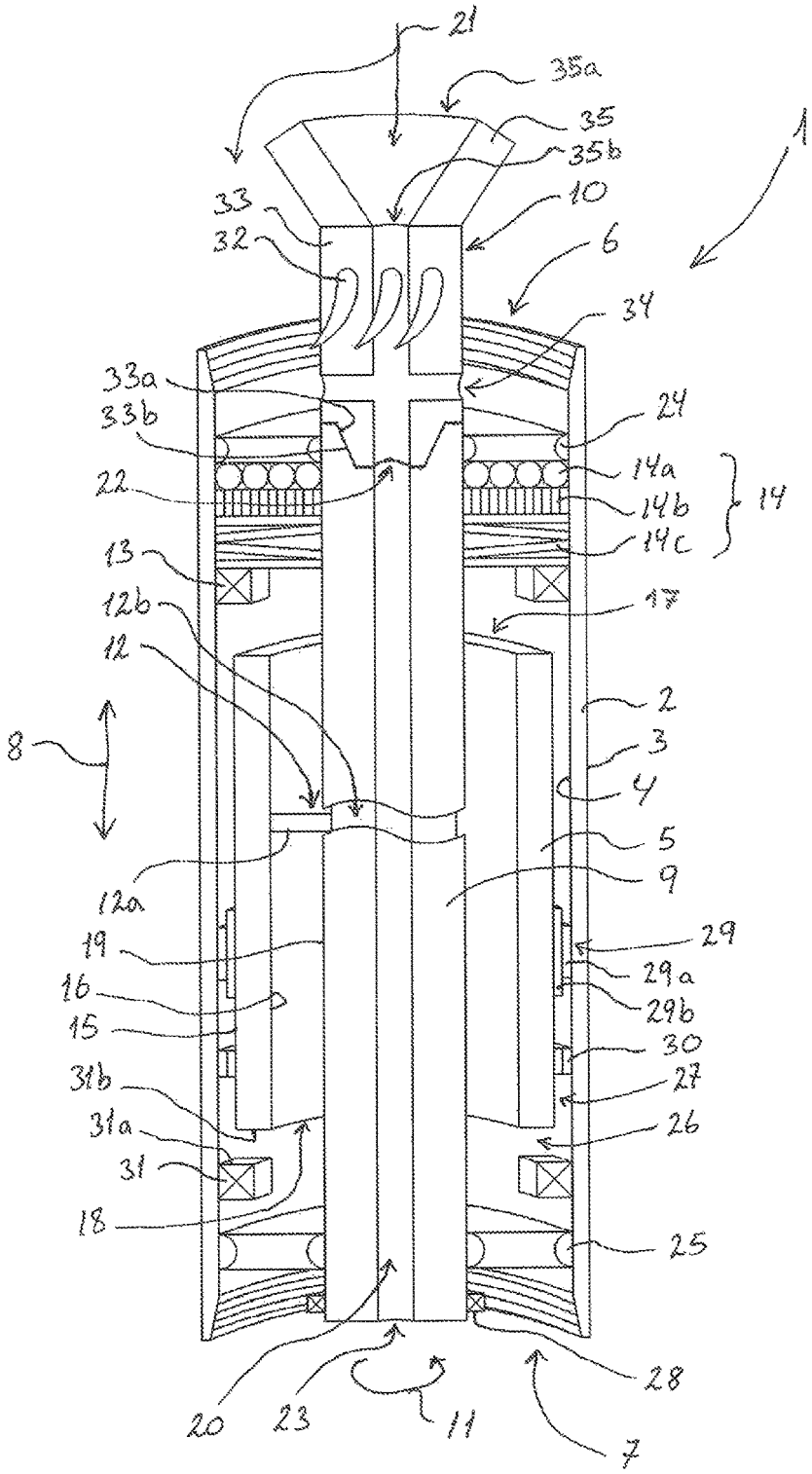
FIG. 1 shows a first exemplary embodiment of an agitator tool according to the invention.

FIG. 1 shows a first exemplary embodiment of an agitator tool 1 for introducing axial movement in a downhole tool of a drill string in a bore hole (not shown). The agitator tool 1 may comprise a first housing 2 configured to be placed in the bore hole and which may have a cylindrical shape. The housing 2 has an outer surface 3 facing the inner surface of the bore hole and an inner surface 4 facing at least one moveable element 5 arranged inside the housing 2. The housing 2 may comprise a first open end 6 connected to a second open end 7 via the sides of the housing 2. The housing 2 may be made of a metal, such as steel, iron or another suitable material. The length and outer diameter of the housing 2 is adapted to the desired application of the agitator tool 1.

The moveable element 5 is in the form of a weight element that configured to be moved in an axial direction (marked with arrow 8) relative to the housing 2. A second moveable element 9 may be arranged inside the housing 2 and coupled to the first element 5. The second element 9 is in the form of an activation element and is configured to be driven solely by a fluid activated drive unit 10. The second element 9 is configured to rotate in a lateral (circumferential) direction (marked with arrow 11) relative to the housing 2. The first and second elements 5, 9 may be coupled together via a mechanical coupling 12 configured to convert the lateral movement of the second element 9 into the axial movement of the first element 5. The elements 5, 9 may be of metal, such as steel, iron, lead or another suitable material. The mechanical coupling 12 may comprise a pin 12*a* and a groove 12*b* configured to at least partly receive the pin 12*a* and guide it along the groove 12*b* when the second element 9 is rotating.

A support element 13, in the form of one or more taps, may be arranged on the inner surface 4 of the housing 2 and may be coupled to the housing by fastening means, such as bolts or welding, or may form part of the housing 2. A stack 14 may be placed on a contact surface of the support element 13 and rotatable coupled to the element 5. The stack 14 may comprise a thrust bearing 14*a*, a radial bearing 14*b*, and one or more spring elements 14*c* for dampening axial movements of the second element 9 and suspending the elements 5, 9.

The first element 5 may be a cylinder having an outer surface 15 facing the inner surface 4 of the housing 2 and an inner surface 16 facing the second element 9. A first open end 17 faces the first open end 6 of the housing 2 and is connected to a second open end 18 facing the second open end 7 of the housing 2 via the sides of the cylinder 5. The second element 9 may be a shaft having an outer surface 19 facing the inner surface 16 of the cavity in the first element 5. The second element 9 may extend through the first element 5, as shown in FIG. 1, and towards the open ends 6, 7. A through-hole 20 may be arranged in the second element 9 for leading at least a portion of a drilling fluid (marked with arrow 21) through the agitator tool 1. The through-hole 20 may be connected to one or more inlets 22 located at the open end 6, e.g., in front of the drive unit 10, and one or more outlets 23 located at the open end 7. This allows the through-hole 20 to act as a flow path for the drilling fluid 21.

A sealing system 24 in the form of a deformable element may be arranged between the stack 14 and the support element 13 or on the opposite side of the stack 14. Another sealing system 25 in the form of a moveable pressure compensating system may be arranged near or at the open end 7. The systems 24, 25 form together with the inner surface 4 a closed chamber 26 filled with a second fluid, such as oil. The pressure compensating system 25 may be configured to move freely between a first end position and a second end position for regulating the pressure of the fluid located inside the chamber 26. A gap 27 is arranged between the first element 5 and the inner surfaces of the chamber 26 so that the element 5 is able to move freely inside the chamber 26, even when the system 25 is positioned in one of the end positions. A second inlet and outlet (not shown) are coupled to the chamber 26 for leading the second fluid in and out of the chamber 26. A locking system 28 may be arranged at the end of the second element 9 and define one of the end positions.

Guiding means 29 in the form of a spline system may be arranged between the housing 2 and the first element 5. The spline system 29 may comprise a first spline element 29*a* coupled to the inner surface 4 and configured to be guiding along a second spline element 29*b* coupled to the outer surface 15. The guiding means 29 is configured to restrict the first element 5 to an axial movement relative to the second element 9. A bearing system 30 may be located between the outer surface 15 and the inner surface 4 for centering of the element 5.

One or more protrusions 31, formed as taps may be arranged on the surface 4 at the opposite end of the support element 13. The protrusion 31 comprises a contact surface 31*a* for contacting a contact surface 31*b* on the first element 5. The protrusion 31 may be arranged relative to the first element 5 so that the contact surfaces 31*a*, 31*b* are brought into contact with each other when the first element 5 moves forward.

The drive unit 10 may be a turbine having a plurality of turbine blades 32 arranged on a turbine shaft 33. The turbine blades 32 may be orientated in a clockwise or counterclockwise direction. The shaft 33 may comprise a coupling element 33*a* in the form of a screw thread for coupling to a mating coupling element 33*b* on the element 9. One or more secondary inlets 34 may be located between the turbine blades 32 and the coupling element 33*a* and may be connected to the through-hole 20. A flow regulating system 35 may be arranged in the front of the drive unit 10 for regulating the flow to the turbine blade 32 and to the through-hole 20. The flow regulating system 35 may have a static configuration, e.g., a cone or funnel shaped element, with an inlet 35*a* for leading a portion of the fluid 21 into the flow regulating system 35 and an outlet 35*b* for leading the fluid 21 into the through-hole 20.

Figure 2:
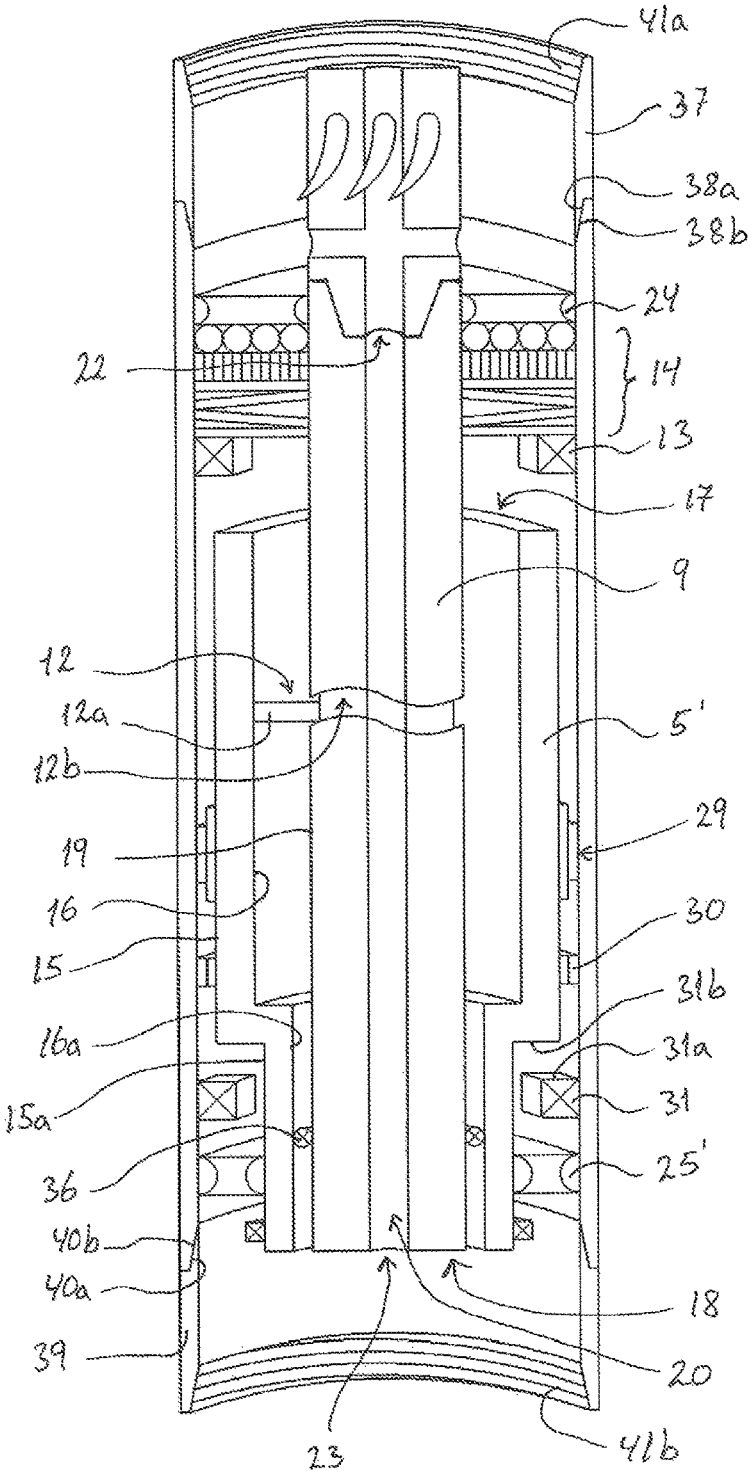
FIG. 2 shows a second exemplary embodiment of the agitator tool.

FIG. 2 shows a second exemplary embodiment of the agitator tool 1' where the first element 5' differs from the first element 5 shown in FIG. 1 by extending past the pressure compensating system 25. The sealing system 25' is configured to move relative to an outer surface 15*a* of the element 5'. A sealing system 36 may be arranged between the outer surface 19 of the second element 9 and an inner surface 16*a* of the first element 5'.

A second housing 37 may be coupled to the first housing 2 at the open end 6. The housing 37 may at one end comprise a first coupling element 38*a* in the form of a screw thread for coupling to a mating coupling element 38*b* at the open end 6 for protecting the drive unit 10. A third housing 39 may be coupled to the first housing 2 at the open end 7 for protecting the ends of the elements 5, 9. The housing 39 may at one end comprise a first coupling element 40*a* in the form of a screw thread for coupling to a mating coupling element 40*b* at the open end 7. The housings 37, 39 may comprise couplings elements 41*a*, 41*b* for coupling to mating coupling elements of another housing or an external downhole tool (not shown).

Figures 3, 4, 5, 6:
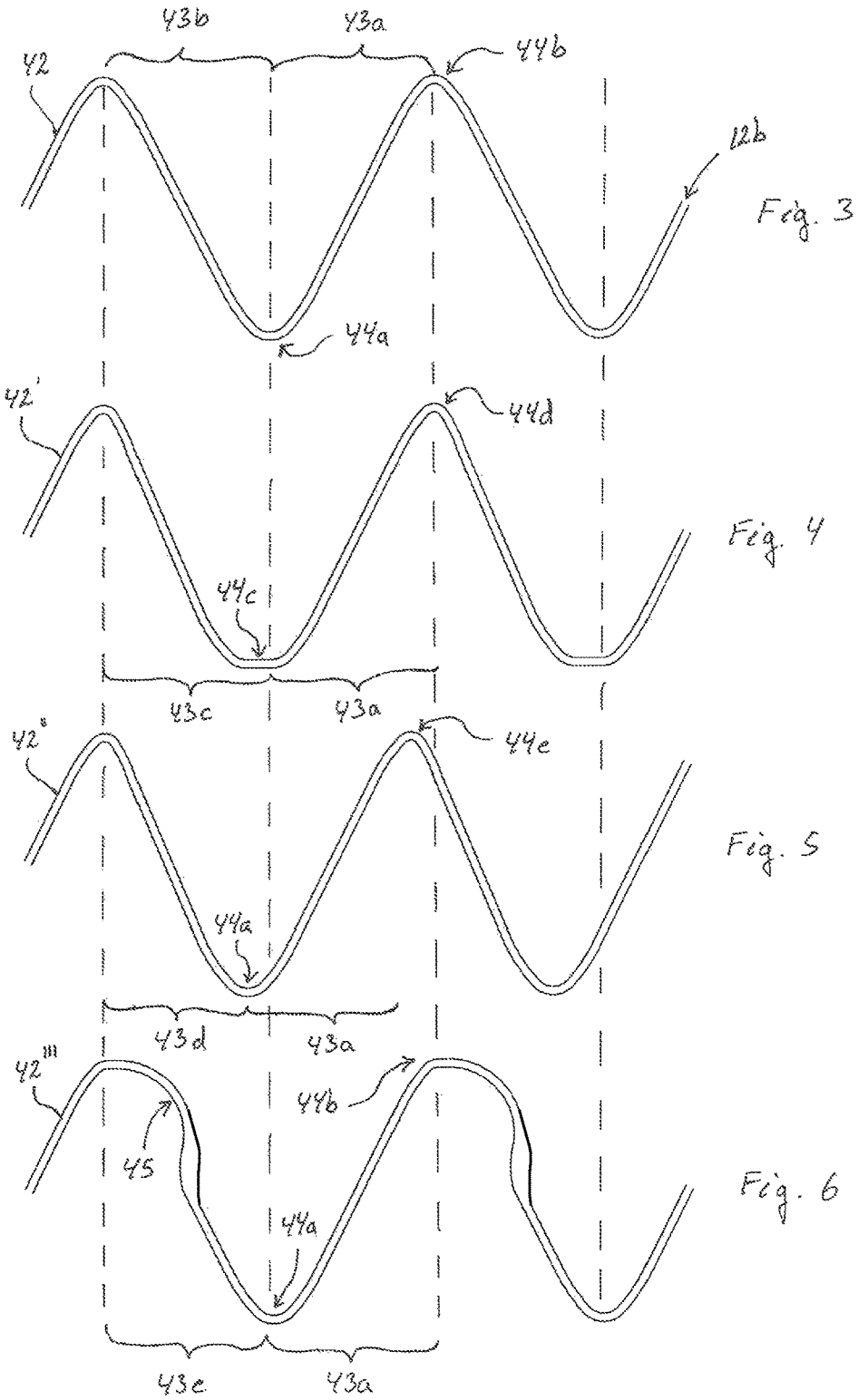
FIG. 3 shows a first embodiment with an unmodified groove according to the invention.
FIG. 4 shows a second embodiment with a modified groove.
FIG. 5 shows a another embodiment of the modified groove.
FIG. 6 shows a further embodiment of the modified groove.

FIG. 3 shows a first exemplary embodiment of the mechanical coupling 12 in the agitator tool 1 where the pin 12*a* is omitted. The groove 12*b* may form a closed loop 42 defining a first groove section 43*a* for forward movement of the first element, i.e. towards the open end 7, and a second groove section 43*b* for backward movement of the first element, i.e., towards the open end 6. The groove sections 43 are connected via a first and a second unmodified peak sections 44*a*, 44*b*. The sections 43, 44 may form an unmodified sinus shaped groove. The groove sections 43 form at least one cycle with a predetermined amplitude, frequency/period and pitch which introduce a neutral oscillating movement in the agitator tool 1.

Unlike the unmodified sinus shaped groove of the FIG. 3 embodiment, the embodiments of FIGS. 4-6 have modified, i.e., asymmetric, sinus shaped grooves.

FIG. 4 shows a second exemplary embodiment of the closed loop 42' where the sections 43, 44 form a modified sinus shaped groove. In this embodiment, the second groove section 43*c* may be modified (pitch increased) so that the backward movement of the first element 5 is accelerated. The peak section 44*c* connected to the groove sections 43*a*, 43*c* may be modified so that the movement of the first element 5 is slowly stopped (pitch decreased). The peak section 44*d* connected to the groove sections 43*a*, 43*c* may be modified so that the movement of the first element 5 is quickly stopped (pitch increased). The amplitude and/or frequency of the cycle may be the same as shown in FIG. 3.

FIG. 5 shows a third exemplary embodiment of the closed loop 42" where the sections 43, 44 form a modified sinus shaped groove. This embodiment differs from the embodiment of FIG. 4 in that the peak section 44*e* may be modified (pitch increased) so that the movement of the first element 5 is quickly stopped (Pitch increased). The second groove section 43*d* may be modified (pitch increased) so that the backward movement of the first element 5 is accelerated. The peak section 44*a* is not modified which means that the frequency of the cycle is increased. The amplitude of the cycle may differ from the one shown in FIG. 3.

FIG. 6 shows a fourth exemplary embodiment of the closed loop 42'" where the sections 43, 44 form a modified sinus shaped groove. The second groove section 43*e* may comprise a sub-section 45 located towards the peak section 44*a* or the peak section 44*b*. The groove sub-section 45 may be shaped so that the first element 5 performs a second and smaller cycle, i.e., stroke movement, during the backward movement. The groove subsection 45 may alternatively be located on the first groove section 43*a*. The amplitude, frequency and/or pitch of the remaining cycle may be the same as shown in FIG. 3. The groove 12*b* may at the point where the first element 5 contacts the protrusion 31 have a greater width than the width of the remaining part of the groove 12*b*, as shown in FIG. 6.

The configuration of the groove 12*b* is not limited to the embodiments shown in FIGS. 3-6 and may form any desired shape. The groove 12*b* may be configured so that the first element 5 performs any number of cycles per revolution of the second element 9, preferably one, two, three, four or more. The size, length and configuration of the agitator tool 1 is not limited to the embodiments shown in FIGS. 1-2 and the elements 5, 9 may be adapted to the desired application. Any number of first elements 5 may be arranged along the length of the second element 9, preferably one, two or more, and the mechanical coupling 12 between the second element 9 and each of the first elements 5 may differ.

What is claimed is:

1. An agitator tool for introducing axial movement in a downhole tool, where the agitator tool comprises:

a housing configured to be positioned in the bore hole, wherein the housing has a first open end connected to a second open end via at least an inner surface, and wherein the housing is configured to guide at least a portion of a drilling fluid through the housing via the first and second open ends;

a drive unit configured to drive the agitator tool, wherein the drive unit is configured to be coupled to a first moveable element arranged inside the housing;

wherein the first moveable element is configured to move in an axial direction relative to the housing for introducing axial movement in an external downhole tool coupled to the agitator tool when the drive unit drives the first moveable element, a second moveable element arranged inside the housing, wherein the second moveable element is configured to be coupled to the drive unit and to rotate relative to the first moveable element, wherein the first and second movable elements are arranged relative to a common center axis, and wherein rotational movement of second moveable element relative to the first movable element is caused solely by the drive unit, the first moveable element is coupled to the second moveable element via mechanical coupling means for converting the rotational movement of the second moveable element into the axial movement of the first moveable element, wherein the coupling means comprises a first coupling element located on a first surface of the first moveable element which is configured to engage a second coupling element located on a second and opposite facing surface of the second moveable element, and wherein the first coupling element is configured to move along the second coupling element when the drive unit drives the second moveable element, wherein the second coupling element forms at least a first guiding section for forward axis movement of the first coupling element, where the first guiding section is connected to at least a second guiding section for backward axis movement of the first coupling element, and wherein the first and second guiding sections form a guiding loop for the axial movement of the first coupling element, wherein the guiding sections are formed by an asymmetric sinusoidal groove in the second moveable element that is shaped to produce forward axial movement without an equal backward axial movement.

2. An agitator according to claim 1, wherein one of the coupling elements is a pin extending out from the first or second surface of one of the first and second elements and the other coupling element is the groove, the groove being configured to at least partly receive a free end of the pin, and wherein axial movement of the second movable element relative to the first movable element is produced solely by the drive unit causing the second movable element to rotate relative to the first moveable element.

3. An agitator according to claim 1, wherein one of the guiding sections has a guiding subsection which has a third shape that differs from the remaining shape of that guiding section for a third axis movement of the first coupling element.

4. An agitator according to claim 1, wherein the first moveable element is a cylinder and the second moveable element is a shaft and wherein the cylinder has a first surface facing the shaft and the shaft has a second surface facing the cylinder, and where the shaft extends at least partly into a cavity of the cylinder.

5. An agitator according to claim 4, wherein a pressure compensating system is arranged at the second open end for compensating for a pressure difference between a fluid inside the housing and a second fluid outside the housing.

6. An agitator according to claim 1, wherein guiding means is arranged between an outer surface of the second moveable element and the inner surface of the housing for restricting movement of the first moveable element to an axis movement relative to the second moveable element.

7. An agitator according to claim 1, wherein at least a first sealing system is arranged at the first open end, wherein at least one of the first and second movable elements extends through the sealing system and comprises at least one inlet opening connected to a fluid path which is connected to at least one outlet opening.

8. An agitator according to claim 1, wherein at least one protrusion is arranged on the inner surface of the housing and comprises a first contact surface for contacting a second surface on the first moveable element when the first moveable element moves in an axial direction.

9. An agitator according to claim 1, wherein at least another moveable first moveable element is coupled to the second moveable element by another set of coupling means, wherein the set of coupling means comprises a third coupling element configured to move along a fourth coupling element when the drive unit drives the second moveable element.

10. An agitator according to claim 1, wherein the drive unit is configured as a turbine or progressive cavity pump, wherein the drive unit comprises at least one blade arranged on a shaft for leading at least a part of the drilling fluid through the drive unit, and wherein flow regulating means are arranged in front of the drive unit.

11. An agitator according to claim 1, wherein the drive unit is a fluid activated drive unit.

* * * * *